US007354388B2

(12) United States Patent
Mackel et al.

(10) Patent No.: US 7,354,388 B2
(45) Date of Patent: Apr. 8, 2008

(54) SEPARATOR HAVING A CENTRIFUGAL DRUM AND A PISTON SLIDE

(75) Inventors: Wilfried Mackel, Oelde (DE); Andreas Schulz, Beckum (DE)

(73) Assignee: Westfalia Separator AG, Oelde (DE)

( * ) Notice: Subject to any disclaimer, the term of this patent is extended or adjusted under 35 U.S.C. 154(b) by 2 days.

(21) Appl. No.: 10/581,894

(22) PCT Filed: Sep. 21, 2005

(86) PCT No.: PCT/EP2005/010158

§ 371 (c)(1),
(2), (4) Date: Jun. 6, 2006

(87) PCT Pub. No.: WO2006/045380

PCT Pub. Date: May 4, 2006

(65) Prior Publication Data

US 2007/0135289 A1 Jun. 14, 2007

(30) Foreign Application Priority Data

Oct. 21, 2004 (DE) ..... 10 2004 051 264

(51) Int. Cl.
*B04B 1/14* (2006.01)

(52) U.S. Cl. ..... 494/38; 494/70

(58) Field of Classification Search ..... 494/2–4, 494/38, 40, 43, 56, 68–73
See application file for complete search history.

(56) References Cited

U.S. PATENT DOCUMENTS

| | | | | |
|---|---|---|---|---|
| 3,550,843 | A | 12/1970 | Hoffmann | |
| 4,143,806 | A * | 3/1979 | Moriguchi | 494/29 |
| 4,410,319 | A * | 10/1983 | Zettier et al. | 494/29 |
| 5,916,083 | A | 6/1999 | Björkström | |
| 2005/0143245 | A1 | 6/2005 | Kohlstette et al. | |
| 2007/0135289 | A1 * | 6/2007 | Mackel et al. | 494/38 |

FOREIGN PATENT DOCUMENTS

| | | | |
|---|---|---|---|
| DE | 1 909 996 | | 1/1970 |
| DE | 3133689 | C1 * | 2/1983 |
| DE | 3636034 | C1 * | 4/1988 |
| DE | 102 20 757 | A1 | 11/2003 |
| EP | 1 384 511 | A2 | 1/2004 |

* cited by examiner

*Primary Examiner*—Charles E. Cooley
(74) *Attorney, Agent, or Firm*—Barnes & Thornburg LLP

(57) ABSTRACT

A separator including a rotatable drum having a drum top part, a vertical axis of rotation and a disk stack arranged therein. Also included is a piston slide for opening and closing solids discharge openings in the drum. A radial gap is formed between the drum top part and the piston slide in an open condition of the piston slide. Radially successive annular chambers are located in the piston slide and in the drum top part and are mutually connected by a bottleneck.

25 Claims, 3 Drawing Sheets

SEPARATOR HAVING A CENTRIFUGAL DRUM AND A PISTON SLIDE

BACKGROUND AND SUMMARY

The present disclosure relates to a separator having a rotatable drum with a vertical axis of rotation, in which a plate stack is arranged. The separator includes a piston slide for the opening and closing of solids discharge openings in the drum. In an opened condition of the piston slide, a radial gap is formed between the drum 2, or a top part of the drum, and the piston slide.

In the case of separators of this type, which have piston slides, there is the need to reduce the occurrence of erosive phenomena in the area of the solids discharge openings, particularly evacuation slots, and to minimize the effect of the depositing of contaminations in this area.

Separators with piston slides are illustrated in German Patent Documents DE 38 03 762 A1, DE 102 20 757 A1, DE 44 36 459 C2 and U.S. Pat. No. 5,916,083. Separators with nozzle openings are illustrated in German Patent Document DE 195 27 039 C1 and U.S. Patent Document US 290060, 239.

The present disclosure addresses the above-referenced needs.

The present disclosure relates to a separator that includes a rotatable drum having a drum top part, a vertical axis of rotation and a disk stack arranged therein. Also included is a piston slide for opening and closing solids discharge openings in the drum. A radial gap is formed between the drum top part and the piston slide in an open condition of the piston slide. Also included is at least one annular chamber located on both sides of the radial gap in front of the solids discharge openings in an outer circumference area of the piston slide and the drum top part.

Accordingly, as noted above, at least one annular chamber is constructed on both sides of the gap, radially in front of the solids discharge openings in the outer circumference area of the piston slide and the drum top part.

It may be that two radially successive annular chambers are constructed in the piston slide and in the top part of the drum. The two annular chambers are constructed symmetrically with respect to the contact surface of the piston slide on the top part of the drum in the closed condition. Specifically, this construction causes considerably optimized flow conditions in the area of the discharge openings.

The two annular chambers in the closed condition of the piston slide are constructed symmetrically with respect to the contact surface of the piston slide on the top part of the drum.

A radially interior annular chamber of the annular chambers is constructed as a fanning-out chamber for an exiting stream of solid matter.

A radially exterior annular chamber of the annular chambers is constructed as a swirl chamber for the exiting stream of solid matter.

The present disclosure relates to the flow conditions in the area in front of the solids discharge openings in a simple manner by an optimization of the geometry in the piston solid and drum elements, particularly the top part of the drum, which are connected in front of the solids discharge openings. This results in a corresponding treatment of these elements but not in additional expenditures of material. The separator of the present disclosure can be implemented in a simple manner and minimizes not only the effect of the erosive phenomena in the area of the solids discharge openings but also reduces the tendency to form deposits. The separator according to the present disclosure contributes to a high operative readiness of the separator and to a reduction of the necessity of cleaning operations, particularly if two annular chambers are provided which follow one another radially and are connected by way of a bottleneck.

Other aspects of the present disclosure will become apparent from the following descriptions when considered in conjunction with the accompanying drawings.

DETAILED DESCRIPTION

Figure 1:
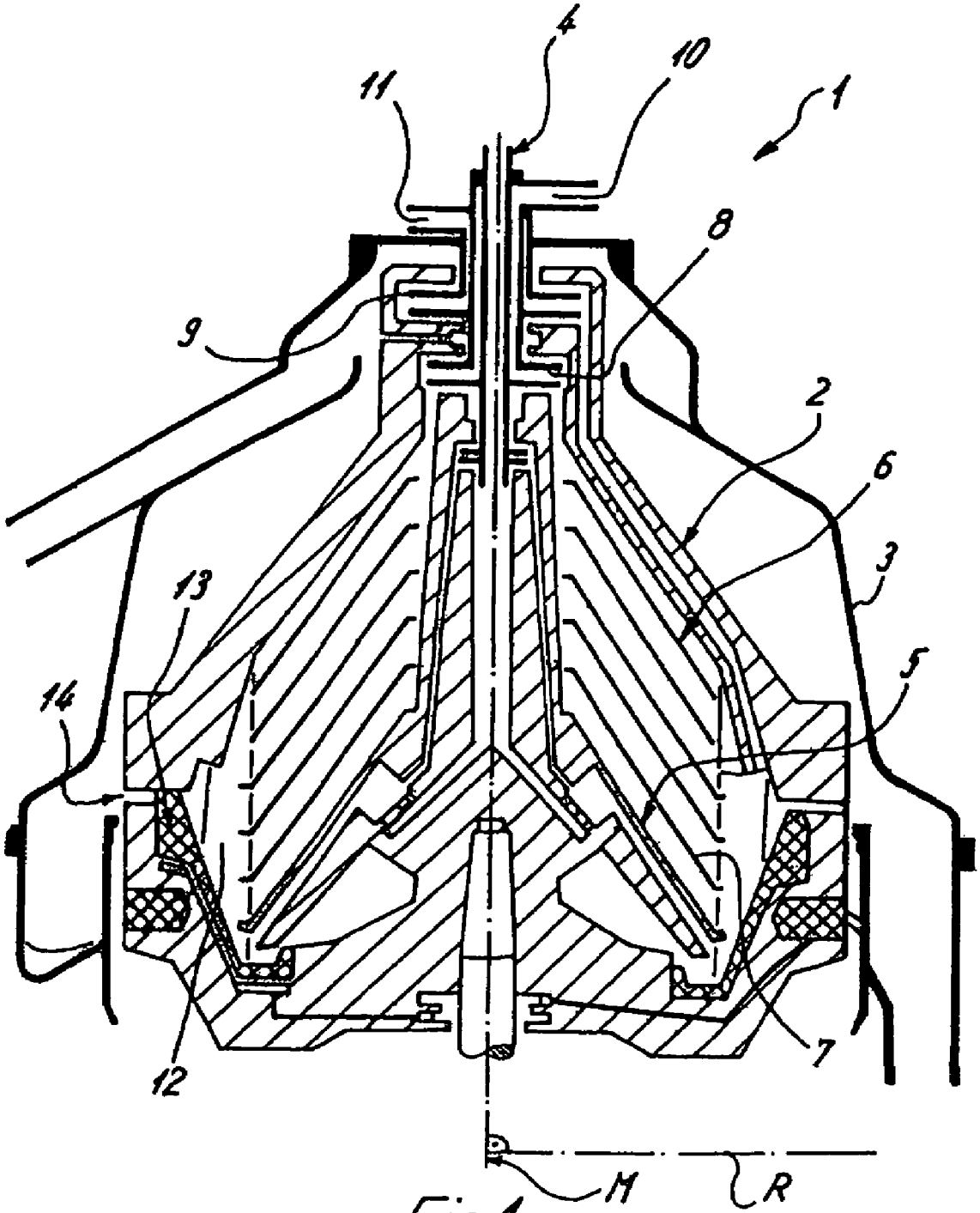
FIG. 1 is a schematic, sectional view of a separator, according to the present disclosure.

FIG. 1 is a schematic sectional view of a separator 1 with a rotatable drum 2 and a one-piece or multiple-piece non-rotatable hood 3 which surrounds the drum completely or for the most part. The drum 2 has a vertical drum axis and axis of rotation M, and has an intake pipe 4 extending, for example, into the drum 2 from above. A distributor 5 is connected on an output side of the intake pipe 4, through which distributor 5 centrifugal material is guided into the drum 2. A disk stack 6 of a plurality of conical disks 7 is arranged in the drum 2.

The removal of, for example, two liquid phases from the drum 2 takes place by two centripetal pumps or grippers 8, 9 to which outlet pipes 10, 11 are assigned.

Figure 2:
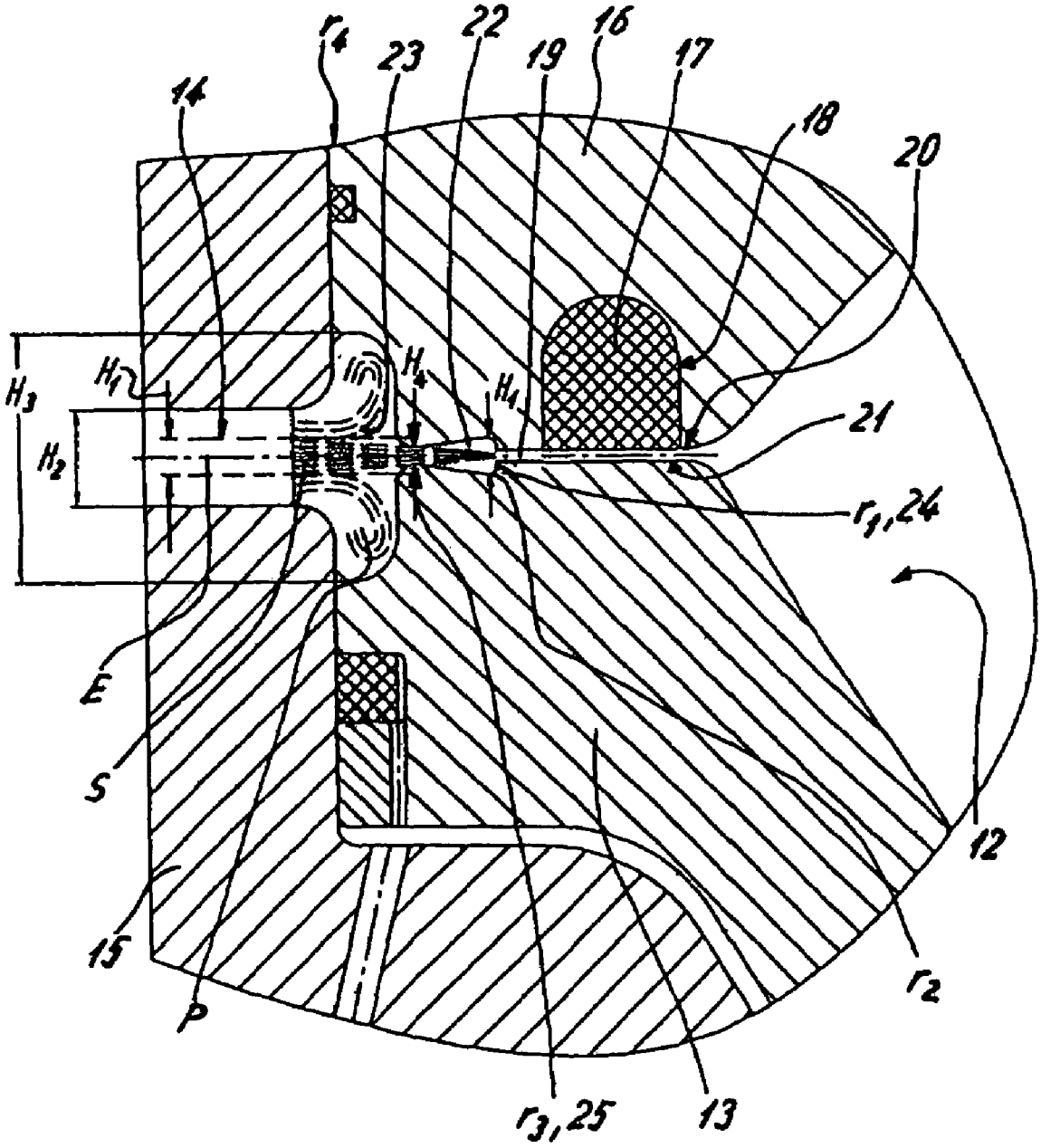
FIG. 2 is a view of an area of a solids discharge opening on the drum of the separator of FIG. 1 when the piston slide is open.
Figure 3:
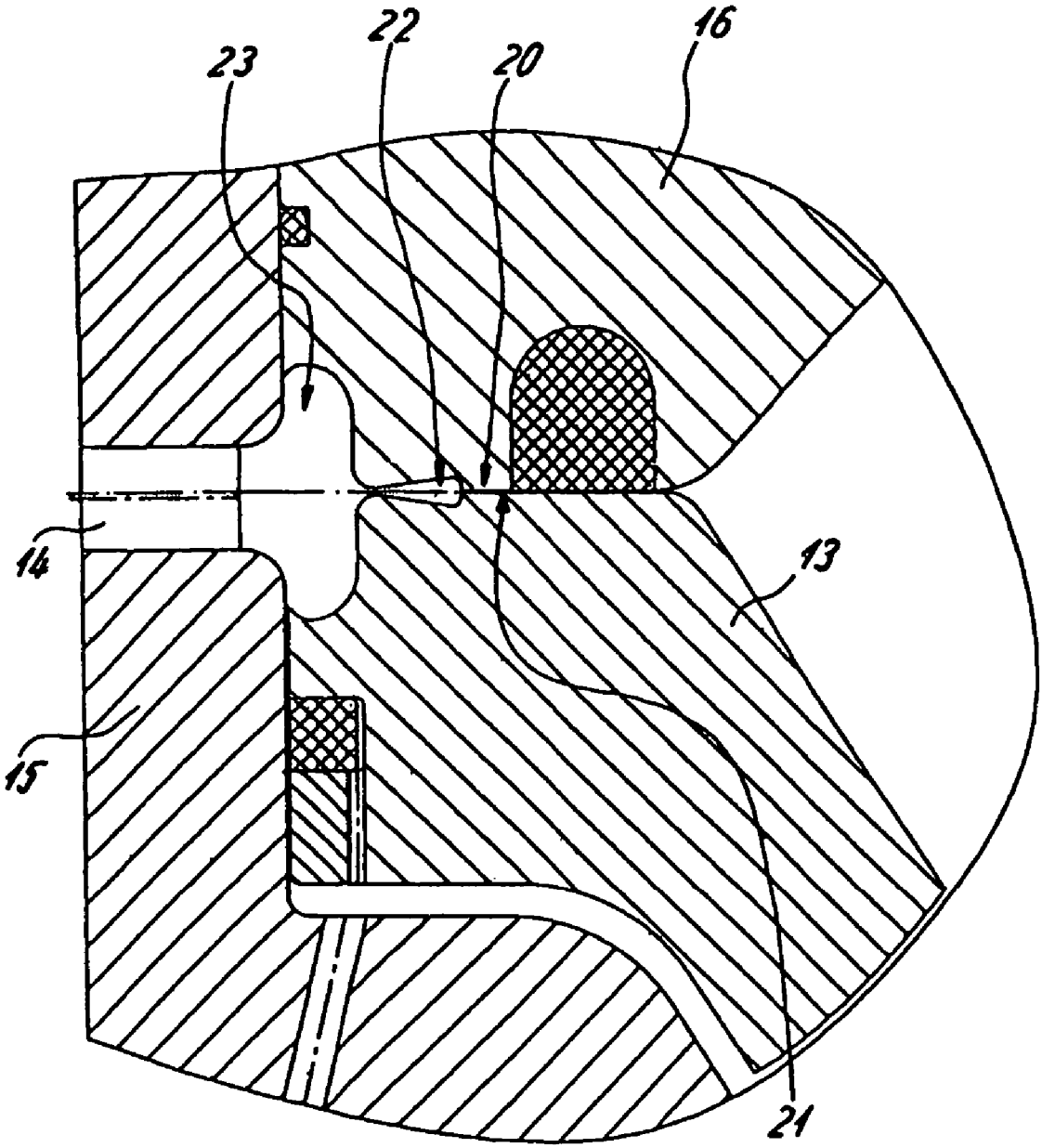
FIG. 3 is a view similar to that of FIG. 2, when the piston slide is closed.

For discharging solids accumulating in a solids space 12, a piston slide 13 is used, as shown in FIGS. 1 to 3. Piston slide 13 can be operated, for example, pneumatically or hydraulically and opens up or closes solids discharge openings 14.

FIG. 1 is an illustrated embodiment of the separator 1.

According to FIG. 2, the solids discharge openings 14 are constructed as bores or slots in a bottom part 15 of the drum 2, which slides discharge openings 14 extend through the bottom part 15 from an inside to an outside of the bottom part 15. The solids discharge openings 14 are uniformly distributed on a circumference of the bottom part 15 of the drum 2, so that webs (not shown) remain in between the solids discharge openings 14.

In a closed condition of the drum 1, the piston slide 13 rests against a top part 16 of the drum 2 at a lower edge of the top part 16 of the drum 2. A sealing ring 17 is arranged in a groove 18 in the top part 16 of the drum 2. In the closed condition, when the piston slide 13 is moved upward, the sealing ring 17 closes or seals off a gap 19 between adjoining surfaces 20, 21 of the piston slide 13 and of the top part 16 of the drum, as shown in FIG. 3.

When the piston slide 13 is open or opening, an exiting solids stream S impacts in a narrowly focused manner on points of the bottom part 15 of the drum, for example, on edges of the solids discharge openings 14. This leads to erosive phenomena and deposits in the gaps between these elements, mainly in an axial gap between the piston slide 13 and the bottom part 15 of the drum 2 and between the top part 16 of the drum 2 and the bottom part 15 of the drum 2.

FIG. 2 illustrates the open condition of the piston slide 13, in which the gap 19 is formed, and FIG. 3 shows the closed condition of piston slide 13. A width of gap 19 may slightly vary in practice from one opening operation to the next. The following conditions relate to a desired opening position, as suggested in FIG. 2, which, on average, is to be achieved by the piston slide 13. The lower surface 20 of the top part 16 of the drum 2 represents a fixed reference plane, from which the piston slide 13 moves away during the opening.

Two radially successive annular chambers 22 and 23 are constructed radially outside the sealing groove 18 in the piston slide 13 and the top part 16 of the drum 2 on both sides of the gap 19. The chambers 22, 23 lie symmetrically in the open condition with respect to a center plane E of the gap 19, and in the closed condition, symmetrically with respect to the surface 20. Annular chambers 22 and 23 extend either in a surrounding manner over an entire circumference or at least on a circumference over an area which corresponds with the solids discharge openings 14.

References to the interior and the exterior annular chambers 22, 23 apply to the interior and exterior annular chambers in the piston slide 13 and in the top part 16 of the drum 2.

The radially interior annular chamber 22 starts just radially outside the sealing groove 18 in the top part 16 of the drum 2 or at a corresponding point of the piston slide 13 at a sharp edge 24 at a radius $r_1$ starting from the drum axis M or measurable from a groove edge of the groove 18. Chamber 22 widens at a radius point $r_2$ to a maximal axial dimension $H_1$, where axial means a direction parallel to the drum axis M and then narrows again to an axial dimension $H_4$ at a narrowing or bottleneck 25 at a radius point $r_3$.

A nozzle-type fanning-out chamber 22 is thereby created which, in an average open condition, has a radial dimension $r_3-r_1$, which is more than twice as large as a maximal axial dimension or height $H_1$.

In the average open condition, the axial dimension of the narrowing 25 is greater than a height or axial dimension of the gap 19.

In the average open condition, the maximal axial dimension $H_1$ of the fanning-out chamber 22 is smaller, for example, more than 50% smaller than the axial dimension $H_2$ of the solids discharge openings 14 in the bottom part 15 of the drum 2.

As a result, the solids stream exiting through the gap 19 when the piston slide 13 is open is fanned out widely and impacts largely unbundled on a web of the bottom part 15 of the drum 2. This has the purpose of minimizing as much as possible the erosion wear on the bottom part 15 of the drum 2 caused by the stream of solid matter.

Starting from the narrowing 25, recesses in the piston slide 13 and drum top part 16 elements widen with an increasing radius, shown as R in FIG. 1, to the drum axis M on both sides of the gap 19 almost in the manner of a ring with quadrant geometry to form the radially exterior annular chamber 23. However, these annular chambers 22, 23 widen beyond the axial dimension or height $H_2$ of the solids discharge openings 14 to an axial dimension $H_3$ which is larger, possibly more than twice as large, than the axial dimension $H_2$ of the solids discharge openings 14 in the average open condition.

The annular chambers 22, 23 then narrow slightly just in front of outer radius $r_4$ of the piston slide 13. Then axially, relative to the drum axis M, on both sides of outer edges of the solids discharge openings 14, chambers 22, 23 abut an inner circumferential wall of the bottom part 15 of the drum 2 at the outer radius $r_4$ at a gap between the piston slide 13 and the bottom part 15 of the drum 2 or between the top part 16 of the drum 2 and the bottom part 15 of the drum 2.

During the exiting of the solids from the interior annular chamber 22, the solids impact at a high speed on the inner circumferential wall of the bottom part 15 of the drum 2, so that a portion of the exiting stream of solids is reflected back into the annular chamber 23. These particles are guided in the annular chamber 23 in the curved manner of arrows P and then exit from the solids discharge openings 14. Thus, a depositing of solids in an area of these annular chambers 22, 23 and/or of the gaps between the bottom part 15 of the drum 2 and the piston slide 13 and the top part 15 of the drum 2 is effectively prevented.

In the case of conventional separators, an exit height of the gap 19 is smaller than that of the solids discharge openings 14. In the present disclosure, the exit height $H_3$ of gap 19 is larger than a height $H_2$ of the solids discharge openings 14.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A separator, comprising:

a rotatable drum having a drum top part, a vertical axis of rotation and a disk stack arranged therein;

a piston slide for opening and closing solids discharge openings in the drum;

a radial gap formed between the drum top part and the piston slide in an open condition of the piston slide; and at least one annular chamber located on both sides of the radial gap in front of the solids discharge openings in an outer circumference area of the piston slide and the drum top part; and wherein two radially successive annular chambers are located in the piston slide and in the drum top part and are mutually connected by a bottleneck.

2. The separator according to claim 1 wherein in the open condition, an exit height of the radial gap at the solids discharge openings is greater than a height of the solids discharge openings.

3. The separator according to claim 1, wherein the two radially successive annular chambers are symmetrically located with respect to a contact surface of the piston slide on the drum top part in a closed condition of the piston slide.

4. The separator according to claim 3, wherein one of the radially successive annular chambers is a radially interior annular chamber and is constructed as a nozzle-type fanning-out chamber for an exiting stream of solids.

5. The separator according to claim 4, wherein the radially interior annular chamber starts radially outside a groove for a sealing device in the drum top part or at a corresponding point of the piston slide.

6. The separator according to claim 4, wherein the nozzle-type fanning-out chamber has a radial dimension of $r_3$ minus $r_1$, which, in an average open condition, is more than twice as large as a maximal axial dimension $H_1$ of the fanning-out chamber in the open condition of the piston slide.

7. The separator according to claim 6, wherein the maximal axial dimension $H_1$ in the open condition is smaller than an axial dimension of the solids discharge openings.

8. The separator according to claim 7, wherein the maximal axial dimension $H_1$ in the open condition is 50% smaller than the axial dimension of the solids discharge openings.

9. The separator according to claim 3, wherein one of the radially successive annular chambers is a radially exterior annular chamber and is constructed as a swirl chamber for an exiting stream of solids.

10. The separator according to claim 9, wherein the radially exterior annular chamber has a greater axial dimension than a radially interior annular chamber.

11. The separator according to claim 9, wherein the radially exterior annular chamber has a greater axial dimension than an axial dimension of the solids discharge openings.

12. The separator according to claim 9, wherein in the open condition of the piston slide, the radially exterior annular chamber has an axial dimension which is more than twice as large as an axial dimension of the solids discharge openings.

13. The separator according to claim 9, wherein the radially exterior annular chamber has a rounded cross-section, so that liquid is swirled therein.

14. A separator, comprising:

a rotatable drum having a drum top part, a vertical axis of rotation and a disk stack arranged therein;

a piston slide for opening and closing solids discharge openings in the drum;

a radial gap formed between the drum top part and the piston slide in an open condition of the piston slide; and at least one annular chamber located on both sides of the radial gap in front of the solids discharge openings in an outer circumference area of the piston slide and the drum top part;

wherein two radially successive annular chambers are located in the piston slide and in the drum top part;

wherein one of the radially successive annular chambers is a radially interior annular chamber and is constructed as a nozzle-type fanning-out chamber for an exiting stream of solids; and wherein the radially interior annular chamber starts radially outside a sealing groove in the drum top part or at the corresponding point of the piston slide at a sharp edge at a radius $r_1$, widens to a radius $r_2$ to a maximal axial dimension $H_1$ and then narrows to an axial dimension $H_4$ at a radial point $r_3$ so that, in the open condition of the piston slide, the nozzle-type fanning-out chamber is created.

15. The separator according to claim 14, wherein the two radially successive annular chambers are symmetrically located with respect to a contact surface of the piston slide on the drum top part in a closed condition of the piston slide.

16. The separator according to claim 14, wherein one of the radially successive annular chambers is a radially exterior annular chamber and is constructed as a swirl chamber for an exiting stream of solids.

17. The separator according to claim 16, wherein the radially exterior annular chamber has a greater axial dimension than the radially interior annular chamber.

18. The separator according to claim 16, wherein the radially exterior annular chamber has a greater axial dimension than an axial dimension of the solids discharge openings.

19. The separator according to claim 16, wherein in the open condition of the piston slide, the radially exterior annular chamber has an axial dimension which is more than twice as large as an axial dimension of the solids discharge openings.

20. The separator according to claim 16, wherein the radially exterior annular chamber has a rounded cross-section, so that liquid is swirled therein.

21. The separator according to claim 14, wherein the radially interior annular chamber starts radially outside a groove for a sealing device in the drum top part or at a corresponding point of the piston slide.

22. The separator according to claim 14, wherein the nozzle-type fanning-out chamber has a radial dimension of $r_3$ minus $r_1$, which, in an average open condition, is more than twice as large as a maximal axial dimension $H_1$ of the fanning-out chamber in the open condition of the piston slide.

23. The separator according to claim 22, wherein the maximal axial dimension $H_1$ in the open condition is smaller than an axial dimension of the solids discharge openings.

24. The separator according to claim 23, wherein the maximal axial dimension $H_1$ in the open condition is 50% smaller than the axial dimension of the solids discharge openings.

25. The separator according to claim 14, wherein in the open condition, an exit height of the radial gap at the solids discharge openings is greater than a height of the solids discharge openings.

* * * * *